US012650266B2

(12) United States Patent
Andersen et al.

(10) Patent No.: US 12,650,266 B2
(45) Date of Patent: Jun. 9, 2026

(54) HEAT EXCHANGER WATER TRAP

(71) Applicant: KNL HOLDING HJØRRING APS, Løkkem (DK)

(72) Inventors: Martin Rønnov Andersen, Sindal (DK); Kjeld Nedergaard Larsen, Løkken (DK)

(73) Assignee: KNL HOLDING HJøRRING APS, Løkkem (DK)

( * ) Notice: Subject to any disclaimer, the term of this patent is extended or adjusted under 35 U.S.C. 154(b) by 99 days.

(21) Appl. No.: 18/713,775

(22) PCT Filed: Dec. 6, 2022

(86) PCT No.: PCT/DK2022/050266
§ 371 (c)(1),
(2) Date: May 28, 2024

(87) PCT Pub. No.: WO2023/104270
PCT Pub. Date: Jun. 15, 2023

(65) Prior Publication Data

US 2025/0027720 A1 Jan. 23, 2025

(30) Foreign Application Priority Data

Dec. 7, 2021 (DK) ..... PA 2021 70600

(51) Int. Cl.
*F28F 21/00* (2006.01)
*E03C 1/264* (2006.01)
(Continued)

(52) U.S. Cl.
CPC ..... *F28D 7/1607* (2013.01); *E03C 1/264* (2013.01); *F28D 21/0012* (2013.01)

(58) Field of Classification Search
CPC ..... F28D 21/0012; Y02B 30/18; Y02B 30/56; E03C 2001/005; F24D 17/0005
See application file for complete search history.

(56) References Cited

U.S. PATENT DOCUMENTS 5,143,149 A 9/1992 Kronberg
5,148,858 A 9/1992 Ovretveit
(Continued)

FOREIGN PATENT DOCUMENTS

GB 597611 A 1/1948
KR 840000690 A 2/1984
(Continued)

*Primary Examiner* — Eric S Ruppert
(74) *Attorney, Agent, or Firm* — Luedeka Neely, P.C.

(57) ABSTRACT

The present invention relates to a novel heat exchanger water trap particularly suited for utilizing the heat present in hot bathing water. The heat exchanger water trap comprises a shell (5) with a liquid inlet (7) for receiving a liquid to be heated and a liquid outlet (3) for said liquid to exit once heated. The heat exchanger further comprises a heat exchange chamber (6) defined by the shell (5), an upper plate (19), a lower plate (10) and an inner wall (12). A plurality of drainpipes (13) having an inner surface and an outside surface through whish a discard liquid can pass and wherein said plurality of drainpipes (13) passing though the heat ex-change chamber (6), whereby the liquid to be heated is in contact with at least part of the outside surface of said plurality of drainpipes (13).

17 Claims, 6 Drawing Sheets

(51) Int. Cl.
*F28D 7/16* (2006.01)
*F28D 21/00* (2006.01)

(56) References Cited

U.S. PATENT DOCUMENTS

| | | | | |
|---|---|---|---|---|
| 7,996,933 | B2 | 8/2011 | McGregor | |
| 2008/0315577 | A1* | 12/2008 | Pavnaskar | F16L 37/084 285/86 |
| 2014/0311709 | A1 | 10/2014 | Chan | |
| 2014/0338754 | A1 | 11/2014 | Nuti | |
| 2016/0216045 | A1* | 7/2016 | Chan | F28D 7/106 |
| 2017/0121951 | A1 | 5/2017 | Holm et al. | |
| 2017/0198982 | A1 | 7/2017 | Törnquist et al. | |
| 2020/0116439 | A1 | 4/2020 | Chan | |

FOREIGN PATENT DOCUMENTS

| | | | |
|---|---|---|---|
| KR | 200275013 | Y1 * | 5/2002 |
| KR | 20030029517 | A | 4/2003 |
| KR | 20120003351 | U | 1/2012 |
| NL | 2003644 | | 10/2009 |
| WO | 2015136156 | A1 | 9/2015 |

* cited by examiner

HEAT EXCHANGER WATER TRAP

FIELD OF THE INVENTION

The present invention relates to field of energy saving and heat recovery from wastewater, particularly the wastewater from a shower.

BACKGROUND OF THE INVENTION

A significant amount of energy used in both industries and domestic households is consumed through heating water for personal washing, showering, and bathing, and for washing laundry and other applications. In the majority of these use scenarios, the wastewater still holds a decent amount of energy which represents a significant wastage of energy resources. Recovery of energy from wastewater has been disclosed previously.

U.S. Pat. No. 5,143,149 shows a heat exchanger with tubing helically placed in a cylindric shape, within a chamber, which holds the liquid, before being passed along the discharge area. The main problem with this invention is the fact that the space within the chamber, is not sufficiently used. The convective heat transfer area, between the warm wastewater and cold supply water, is small compared to the overall size of the invention. This leads to low efficiency.

US 2017/0121951 A1 shows a flushing assembly comprising a foundation and a heat exchanger. The heat exchanger is designed as a helical channel, with both a hot and cold side. The main issue with this invention is that the heat transfer area is small, compared to what can be achieved. This lowers the overall efficiency of the system.

US 2017/0198982 A1 shows a heat exchanger being submerged into a water trap. The main issue with this invention is that the drain is in one side of the trap, and it is relatively small. Given that they only have one outlet, the dynamic behaviour of the fluid becomes very limited.

EP 1 809 965 B1 shows a helically heat exchanger submerged into a water trap. The drawback of this disclosure is that evenly distributed liquid flow in the tubes cannot ensure reduced efficiency. The tubes are, from the looks of it, in a rectangular form which amplifies the issue. The flow is always going to choose the direction where the pressure loss is at its lowest, and in this scenario, that would be at the bottom of the rectangular tubes. This also causes the efficiency of the heat exchanger to decrease, since only a part of the tube is efficiently used.

KR20030029517A shows a heat exchanger water trap with a heat exchange chamber defined by the shell, an upper plate, a lower plate. A plurality of drainpipes is passing through the heat exchange chamber. The construction of KR20030029517A involves a risk of odours rising from downstream and that the heat exchange is too low.

Thus, there is a need for a new water trap that is both easily accessible for cleaning, easily installed and ensure high efficiency.

SUMMARY OF THE INVENTION

The problems with the previous solutions have elegantly been solved providing a novel heat exchanger water trap.

The heat exchanger water trap for transferring heat from drainpipe discharge according to the invention comprises:

- A shell, said shell comprising a liquid inlet for receiving a liquid to be heated and a liquid outlet for said liquid to exit once heated
- A heat exchange chamber

- a plurality of drainpipes for receiving a discharge liquid such as wastewater or hot bathing water, said drainpipes having an inner surface and an outside surface wherein said plurality of drainpipes passing though the heat exchange chamber, whereby the liquid to be heated is in contact with at least part of the outside surface of said plurality of drainpipes; wherein the heat exchange chamber is defined by the shell, an upper plate, a lower plate at least partially covering the interior of the shell and an inner wall.

In a preferred embodiment the heat exchanger water trap further comprises a discharges system, the discharge system comprising a rising chamber and a trap conduit. The discharge system could be defined by the shell, the lower plate, the inner wall, the upper plate and a bottom plate. In the discharge system a rise wall 14 could be positioned so that liquid cannot pass below it and at the same time leaving an opening 21 for liquid to flow over the top of the rise wall or through a hole in the rise wall. Thereby a liquid rising chamber and a trap conduit can be established in the discharge system. The liquid rising chamber then is defined by the inner wall, the rise wall, the bottom plate and the shell and the trap conduit by the inner wall, the rise wall and the shell.

Thereby, the discharge conduit will function as a weir preventing gasses and odours from rising up through the drainage system from the sewers.

In a preferred embodiment the heat exchanger water trap comprises quick connectors for connecting the heat exchanger water trap to existing piping or to a drainpipe fitting. Quick connectors are connectors that can click on/click off a piping without the use of heavy tool. Examples of quick connectors are snap fit connectors.

The novel water trap has an improved heat exchange compared to the previously disclosed water traps with heat exchanging function. Further, the novel water trap is novel in that the water trap is more accessible for cleaning due to its novel fastening mechanism. The fastening mechanism makes it possible to remove the entire water trap easily so that it can be cleaned in a separate place such as in a sink. Further, the simple construction of the water trap makes the water trap cheaper to manufacture. Thereby, it is possible to have multiple water traps so that while one water trap is being cleaned, a second water trap is put into the drainpipe and vice versa.

The invention further relates to a heat exchanger system comprising a heat exchanger water trap as described above and further comprises a drainpipe fitting, the drainpipe fitting having openings for connecting with existing piping circulating the fluid to be heated, the openings further being adapted to connect with the liquid inlet and the liquid outlet of the heat exchanger water trap respectively.

In a preferred embodiment, the plurality of drainpipes is made of copper, stainless steel, brass or aluminium, or a combination thereof.

In another preferred embodiment, the drain pipe fitting and/or the quick connectors are made of copper, stainless steel, brass or aluminium, or a combination thereof.

In another aspect of the invention, the invention relates to a method of transferring heat between a discard liquid, such as heated bathing water, and a liquid to be heated, such as water, without mixing the liquids comprising the steps of:

- Splitting the discard liquid into a plurality of discard streams
- Introducing a liquid to be heated into a heat exchanger chamber surrounding a plurality of drainpipes through which the plurality of discard streams passes Forcing the liquid to be heated to pass the plurality of drainpipes multiple times Releasing the liquid to be heated in a heated state at a gravitationally higher point than when it was introduced.

By splitting the discard liquid, such as a heated bathing water, into a plurality of discard streams, it is possible to transfer more heat than in the situation where only a single stream of discard liquid is used.

In a preferred version of the method, the method further comprises the steps of:

Collecting and combining the discard streams into a cooled discard liquid.

Discarding the cooled discard liquid via a weir.

By collecting and combining the discard streams after the heat transfer has taken place, it is possible to discard the discard liquid via a weir construction and thereby the traditional weir function can still be achieved with all the advantages this give.

DETAILED DESCRIPTION OF THE INVENTION

As will be appreciated by a person skilled in the art, heat transfer can be increased by increasing the fluid passing across the area at which transfer is wanted. Typically, the water in the furthest corner from the outlet is basically stagnant, which means heat transfer is limited. Also, as hot fluid tends to rise towards the top, due to change in density and therefore buoyancy, tubes located in the bottom of the heat exchanger tend to have a lower efficiency, compared to the ones at the top.

In a preferred embodiment, the heat exchanger water trap comprises heat exchanger baffles. The baffles force the liquid to be heated to pass the plurality of drainpipes several times. The heat exchanger baffles can extend from the sides of the shell, preferably in a cylindrical way and almost covering the entire cross section area of the shell, leaving only a small portion of the cross-sectional area for the liquid to be heated to pass through. Thereby, the liquid to be heated has an extended travel path through the heat exchanging chamber and thereby more heat is transferred. Preferably, the heat exchanger water trap comprises 2-50 heat exchanger baffles, more preferably 10-15 heat exchanger baffles.

In a preferred embodiment, the heat exchanger baffles are aligned in a parallel configuration. Preferably, the heat exchanger baffles are made of a good heat conducting material. Preferably, they are made of a metal such a steel, stainless steel, zinc or copper. Especially copper is preferred.

Further, brass or aluminium can also be used for the heat exchanger baffles, or a combination of steel, stainless steel, zinc, copper, brass and aluminium can be used.

Preferably, the liquid outlet is positioned gravitationally higher than the liquid inlet, whereby a cross counter flow through the heat exchanging chamber is established. Then cold liquid meets the coldest parts of the plurality of drainpipes and as the liquid to be heated passes up and is guided by the heat exchanger baffles continuously meeting warmer and warmer surface of the drainpipes. In this way, heat transfer is further enhanced.

The surface of the heat transfer area can further be increased by increasing the number of drainpipes. By positioning the drainpipes substantially vertical in the heat exchanger water trap, the gravitational forces support the flow through the drainpipes and therefore more drainpipes can be positioned in the water trap without hampering the flow of wastewater significantly. In a preferred embodiment, the water trap comprises more than drainpipes, preferably more than 25 drainpipes, even more preferred more than 50 drainpipes, especially more than 100 drainpipes are used. The advantage of using more drainpipes is as mentioned that a larger surface for heat transfer is available and thus a better heat transfer takes place.

Preferably, the heat exchanger water trap further comprises a hair strainer that is removably attachable to the shell. This makes it possible to perform partial cleaning without removing the water trap. This is relevant in cases of hair being trapped on/in the hair strainer, while the rest of the system is still sufficiently clean for continued operation.

Preferably, the shell and/or the drainpipe fitting is of a substantially cylindrical shape, so as to make it possible to install the heat exchanger water trap in an existing drainpipe. When a discharge system is part of the water trap, a part of the discharge system may be squared.

In a preferred embodiment, the heat exchanger water trap may be integrated to new or existing wastewater pipes, for instance located under the shower room itself.

In principle, the plurality of drainpipes can be made of any good heat conducting material. It is preferred that the plurality of drainpipes are made by a metal such a steel, stainless steel, zinc or copper. Especially copper is preferred.

In a preferred embodiment, the heat exchanger baffles and the plurality of drainpipes are made of the same material.

Preferably, the plurality of drainpipes are locked in place by a lower and an upper plate.

The device is a convenient way of recovering heat energy from wastewater passing through a shower waste trap or at least providing the public with a useful alternative.

Preferably, the connection of the liquid to be heated such as cold water is happening through quick connections.

SHORT DESCRIPTION OF THE DRAWINGS

DETAILED DESCRIPTION OF DRAWINGS

Figure 1:
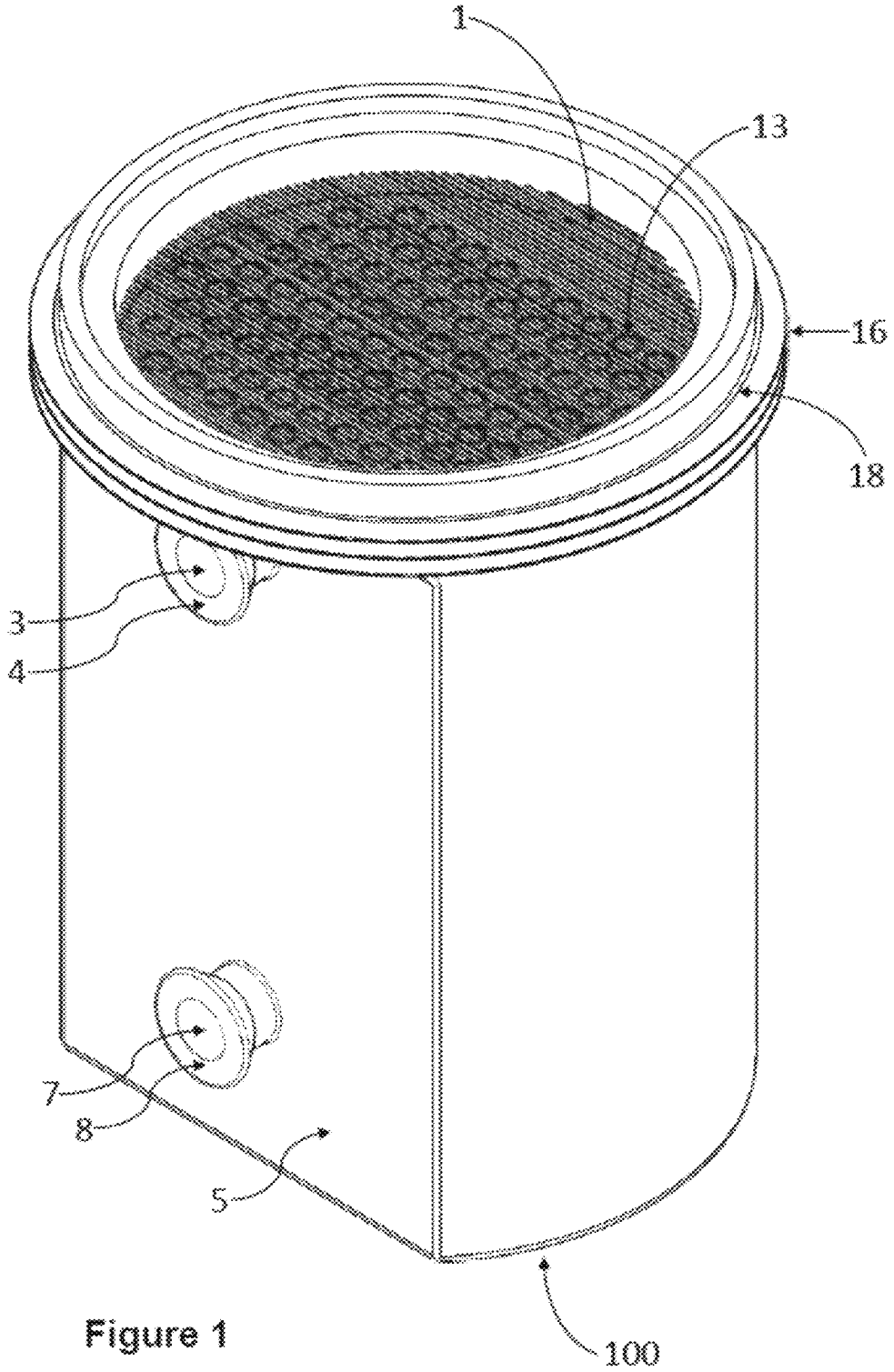
FIG. 1 illustrates a heat exchanger water trap seen partly from above and partly from the side.

Referring to the drawings it will be appreciated that a waste trap can be implemented in various shapes. The following embodiments are described by a way of example only. For convenience of explanation, the drawings show the device orientated as used in a typical application, which is a general vertical position, although the device could be orientated with some degree, depending on the installation surroundings.

FIG. 1 illustrates a water trap 100 seen from the outside. The water trap comprises a substantially cylindrical shell 5 with a liquid inlet 7 for receiving a liquid to be heated and a liquid outlet 3 for releasing the heated liquid. The substantially cylindrical shell has a longitudinal direction Z, 20. The liquid inlet 7 and the liquid outlet 3 are equipped with quick connectors 4, 8 for releasably connecting the waste trap to existing piping circulating the fluid to be heated. The advantage of the quick connectors is that it is possible to remove the entire waste trap during service or cleaning or exchange the waste trap without the use of heavy equipment. Further, in the illustrated embodiment, the liquid outlet 3 is positioned gravitationally higher than the liquid inlet 7, when the water trap is installed. The water trap further comprises a groove 18 into which an O-ring 16 can be fitted. The O-ring stabilizes the waste trap when installed and it also provides a sealing so as to force the wastewater through the water trap. The water trap further comprises a plurality of drainpipes 13 for conveying a heated discharge fluid such as bathing water, shower water etc. and in that process transferring heat to the fluid to be heated. Above the plurality of drain pipes an optional hair strainer 1 in form of a set of wires is positioned so as to retain hair and other objects which could clock the water trap and thereby require more frequent cleaning of the water trap itself.

Figure 2:
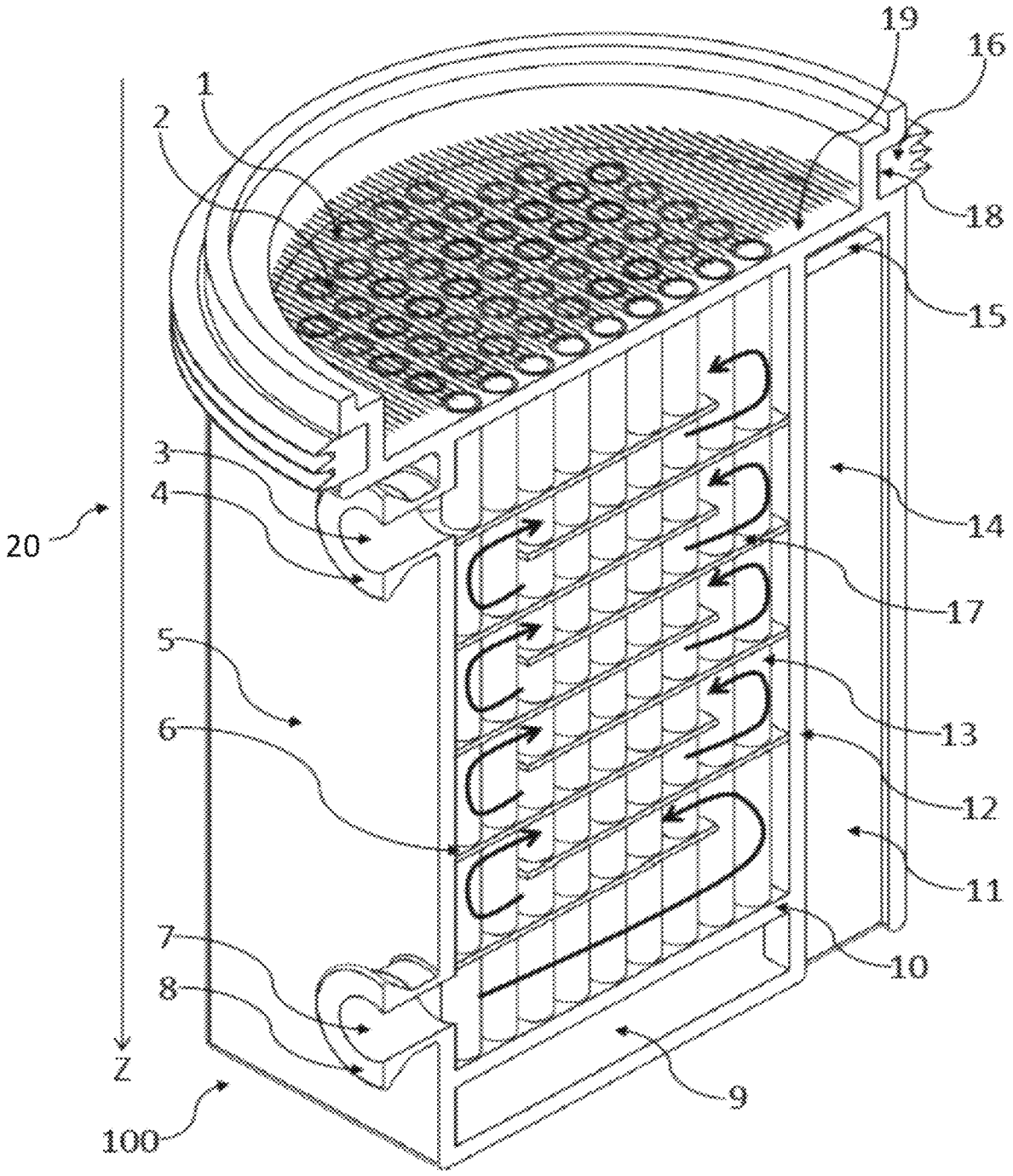
FIG. 2 illustrates the heat exchanger water trap from FIG. 1 cut in half.

FIG. 2 illustrates the water trap from FIG. 1 cut in half so as to illustrate the interior. In the embodiment illustrated in FIG. 2, the water trap comprises a substantially cylindrical shell 5. The shell has an upper plate 19 being perforated with a plurality of drainpipes 13 and a lower plate 10 partially covering the interior of the shell 5. The lower plate extends in a lateral direction to the longitudinal direction Z, the lower plate also being perforated with the plurality of drainpipes. The lower plate 10 can be perpendicular to the longitudinal direction Z, or it can be tilted or slanted. Further, the lower plate can be substantially flat or it can be curved. The plurality of drainpipes 13 have drainpipe inlets 2 and drainpipe outlets in or slightly below the lower plate 10. Below the outlets of the plurality of drainpipes, a bottom plate 9 is provided. The water trap further comprises an inner wall 12 (not visible) dividing the interior of the shell 5 into two parts such that a heat exchange chamber 6 and a discharge system is defined. The heat exchange chamber 6 is defined by the shell 5, the upper plate 19, the lower plate 10 and the inner wall 12. In the figure, the inner wall 12 is shown as a wall of a square, but as will be appreciated by a person skilled in the art, the shape of the wall can be of a variety of shapes such as a curve, an S or similar. The heat exchange chamber 6 is provided with a plurality of heat exchanger baffles 17. The heat exchanger baffles 17 create a longer flow path for the liquid to be heated and create sub-chambers of which the fluid to be heated interacts with the outer side of the drainpipes 13, whereby heat is transferred from the waste fluid to the liquid to be heated. The actual number of heat exchanger baffles 17 depends on the liquid flow rates present in both the drainpipes 13 and the fluid in the heat exchanging chamber 6. The baffles 17 force the liquid to be heated in a counter-cross direction of the waste fluid such as wastewater.

A discharge system is defined by the shell 5, the lower plate 10, the inner wall 12, the bottom plate 9 and the upper plate 19. In the discharge system a rise wall 14 is positioned so that liquid cannot pass below it but at the same time leaving an opening 21 for liquid to flow over the top of the rise wall. Thereby, a liquid rising chamber and a trap conduit is established in the discharge system. When the surface of the wastewater rises to the top of the rise wall, it enters the trap conduit 15 which acts as a weir. Thereby, gasses, odours etc from the sewers or the like are prevented from entering the system upstream of the weir. The flow path of the wastewater will then be as follows. First the wastewater passes though the plurality of drainpipes 13, whereby heat is transferred in the heat exchanging chamber 6. After exiting the plurality of drainpipes 13, the wastewater is stopped by the bottom plate 9 and forced to rise behind the rise wall until it reaches the opening 21 in/above the rise wall 14 and then exits via the trap conduit 15 and a lower trap conduit 11.

The shell 5 may be fixed within a drainpipe with the use of the quick connectors 4, 8 and stabilized by the base trap O-ring 16. Alternatively, the water trap could be integrated with the floor tray of the shower instead of into a drainpipe.

Figure 3:
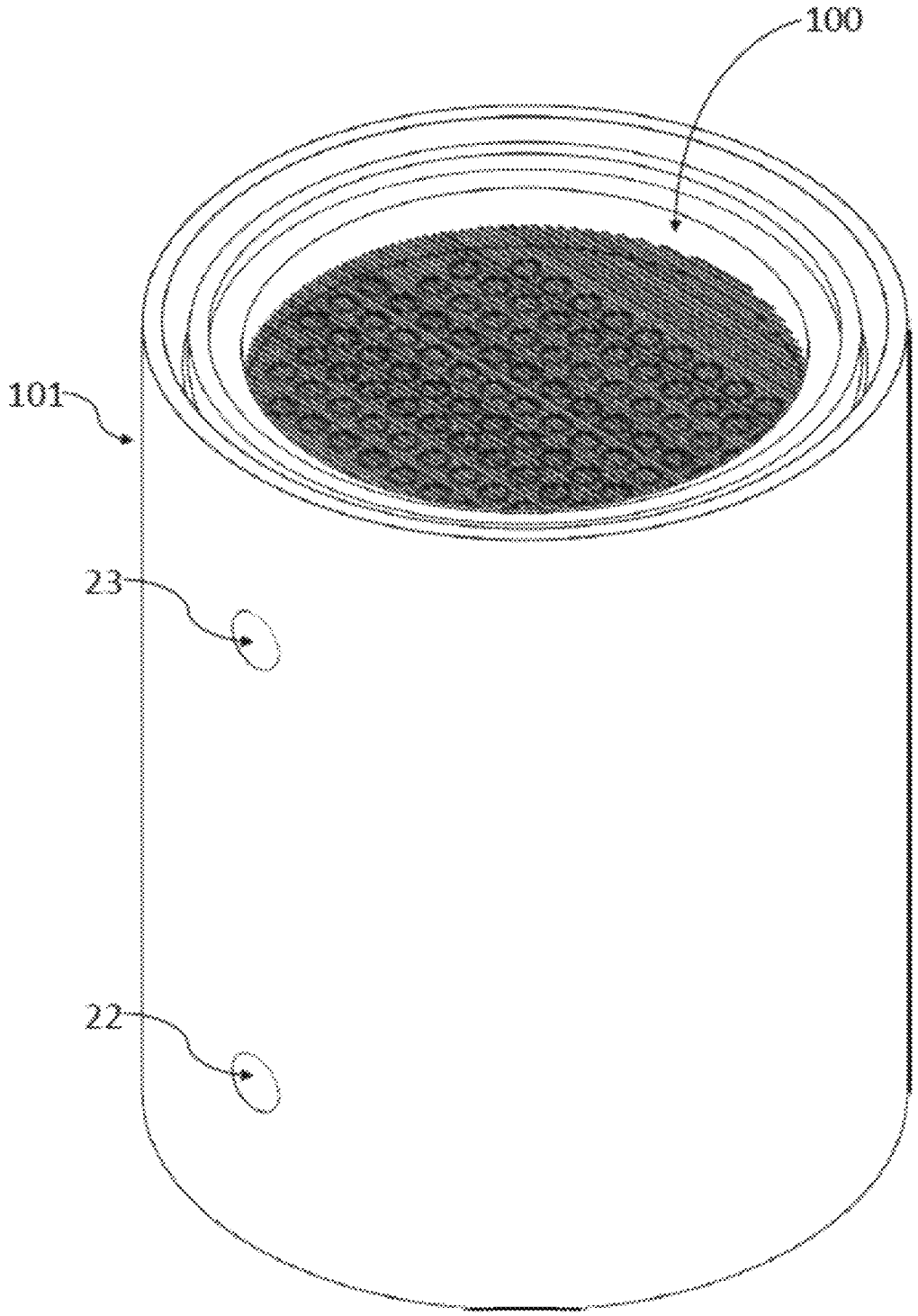
FIG. 3 illustrates a heat exchanger water trap inserted into a drainpipe fitting.

FIG. 3 illustrates an embodiment, where the water trap 100 is inserted into a drainpipe fitting 101. The drainpipe fitting 101 has openings 22 and 23 for the existing piping circulating the fluid to be heated. The drainpipe fitting 101 may be fixed in the drainpipe of a shower floor during construction or later when heat exchanging is desired. The water trap 100 is releasably fixed in the drainpipe fitting 101.

Figure 4:
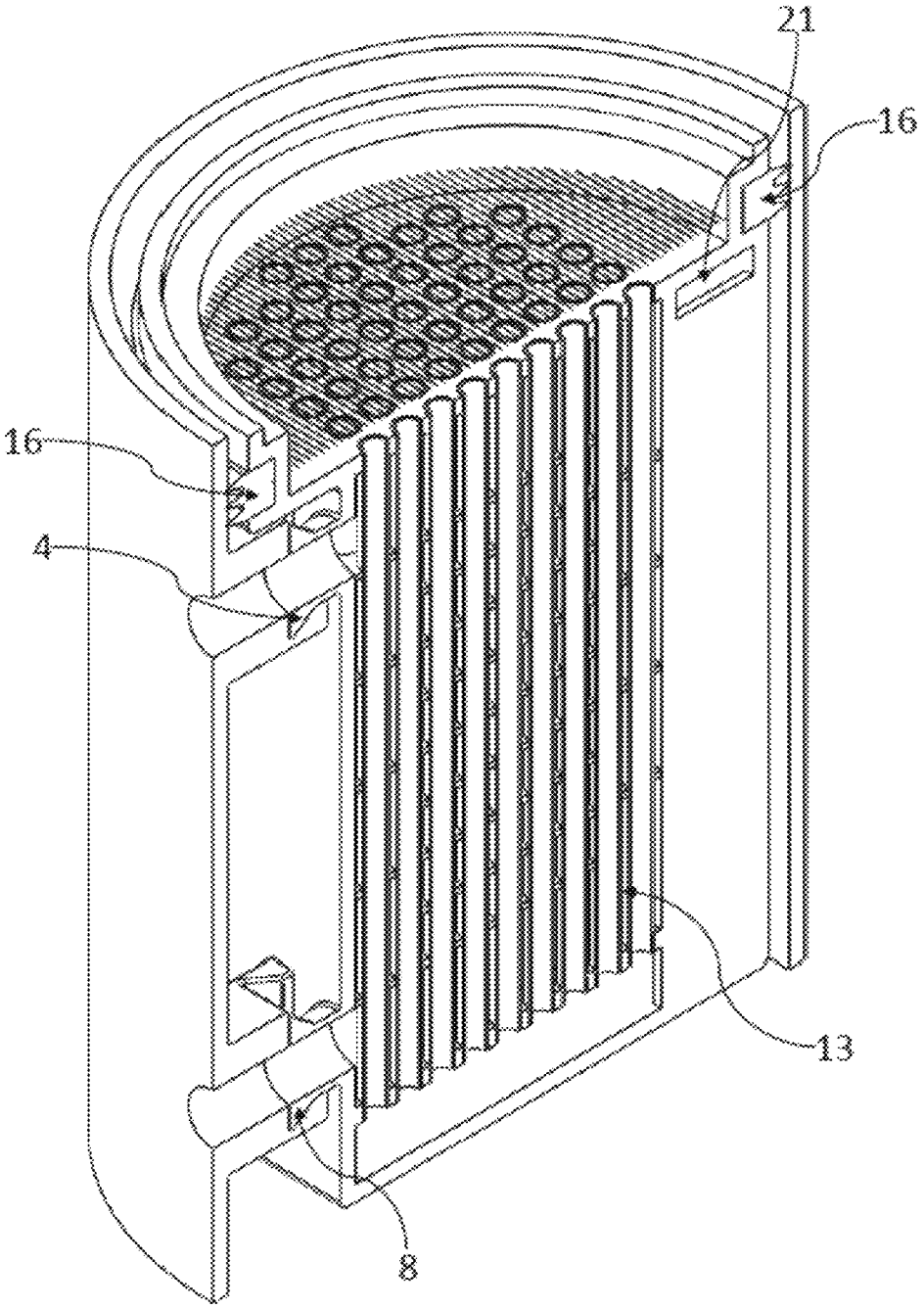
FIG. 4 illustrates the heat exchanger water trap from FIG. 3 cut in half.

FIG. 4 illustrates how the quick connectors 4,8 engage with the drainpipe fitting 101 and thereby connect the fluid inlet 7 and the fluid outlet 3 with the respective openings 22, 23 of the drainpipe fitting, thereby completing the fluid communication from a supply of liquid to be heated via an opening 22 into the fluid inlet 7 and through the heat exchanging chamber 6 before exiting via 4 and 23 into the existing piping. The figure further illustrates how the O-ring 16 seals a gap between the drainpipe fitting 101 and the water trap 101 thereby forcing the waste fluid such as wastewater to run through the water trap and thereby transfer heat. Further, the figure illustrates the multiple heat exchanger baffles 17.

The invention is at first glance meant to be used as a water trap, with a heat exchanger inside, in a regular shower drainpipe, in a regular household. But this invention can also be used in other places, where heated wastewater is present, for instance at public launderettes or swimming pools. The same principle of installing and recovering the heat in wastewater applies at institutions, like these, as in private homes.

Figure 5:
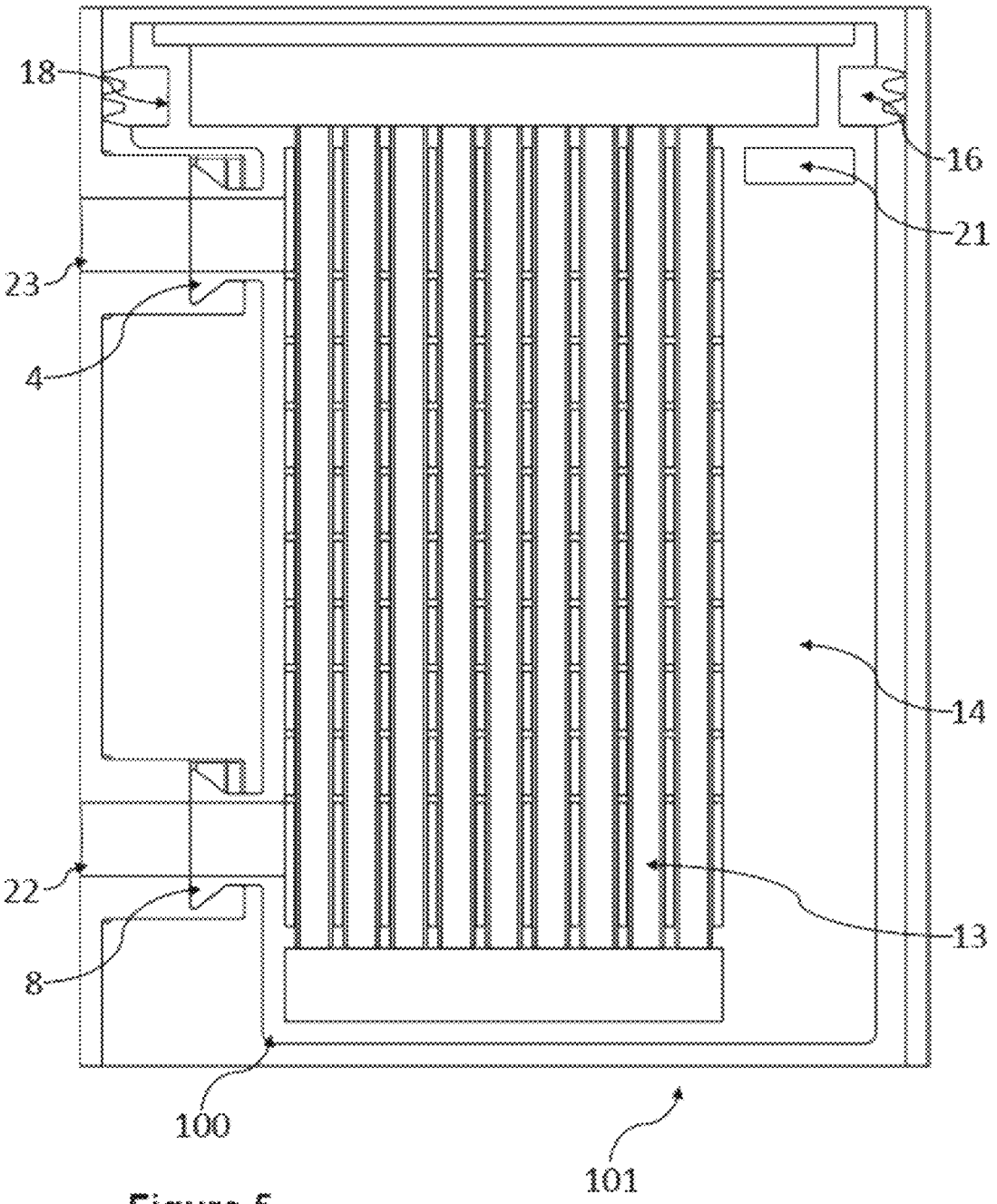
FIG. 5 illustrates a heat exchanger water trap inserted in a drainpipe fitting in a schematic view.

FIG. 5 illustrates a heat exchanger water trap 100 coupled with a drainpipe fitting 101. It can be seen how the openings 22, 23 are adapted to connect with the liquid inlet 7 and the liquid outlet 3 via the quick connectors 4, 8. Further, the figure illustrates an embodiment where there is an opening 21 in the rise wall 14 which functions as a weir. In the top part of the heat exchanger water trap 100 is a groove 18 provided, and in the groove 18 is an O-ring 16 positioned. As can be seen in the figure, the O-ring fits with the drainpipe fitting 101 so that the discard liquid cannot pass outside the water trap and is instead forced to pass through the plurality of drainpipes 13.

Figure 6:
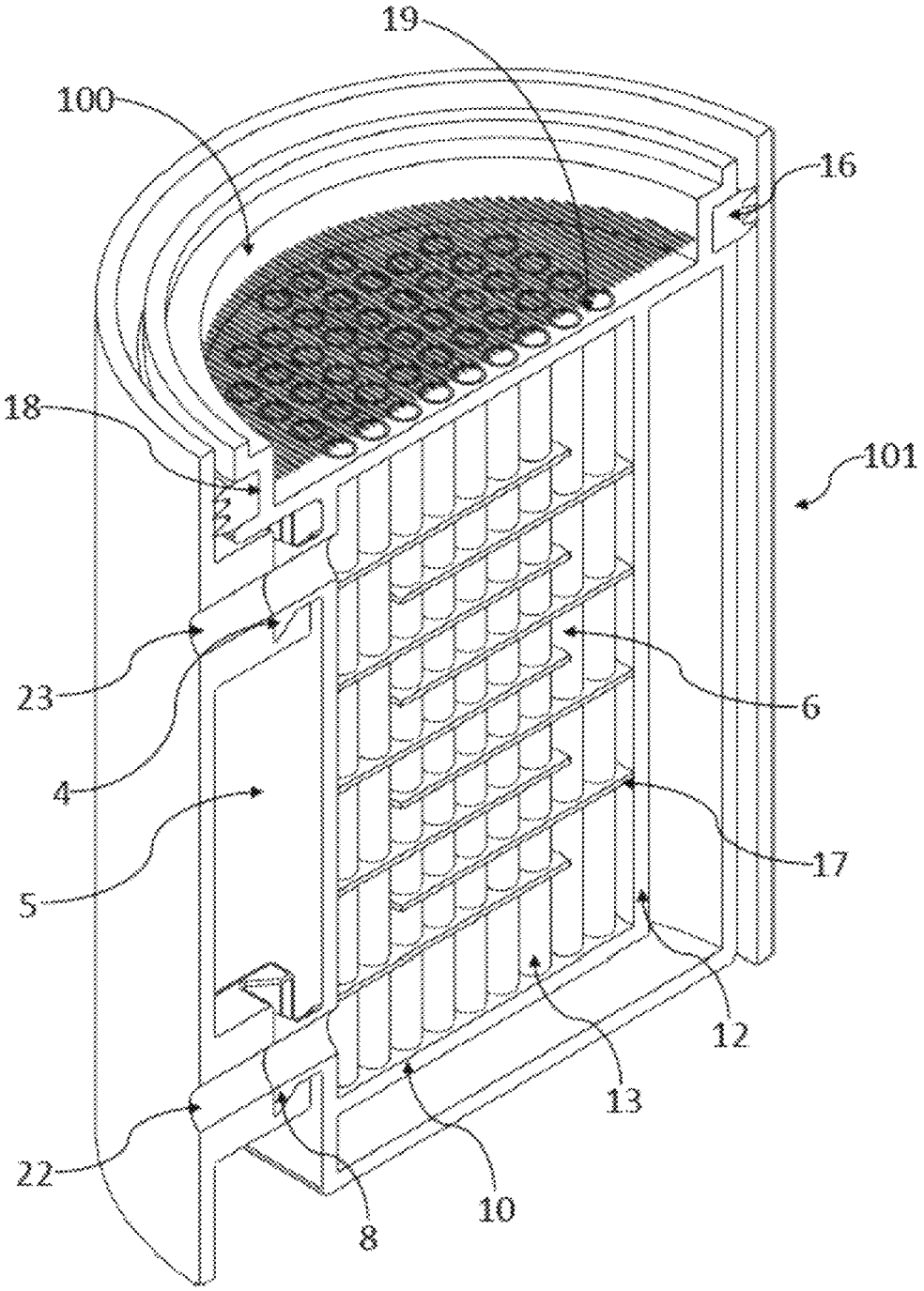
FIG. 6 illustrates a heat exchanger water trap from FIG. 4 with a slightly different cut.

FIG. 6 illustrates how the quick connectors 4,8 engage with the drainpipe fitting 101 and thereby connects the fluid inlet 7 and the fluid outlet 3 with the respective openings 22, 23 of the drainpipe fitting, thereby completing the fluid communication from a supply of liquid to be heated via an opening 22 into the fluid inlet 7 and through the heat exchanging chamber 6 before exiting via 4 and 23 into the existing piping. The figure further illustrates how the O-ring 16 seals a gap between the drainpipe fitting 101 and the water trap 100 thereby forcing the waste fluid such as wastewater to run through the water trap and thereby transfer heat. Further, the figure illustrates the multiple heat exchanger baffles 17. FIG. 6 gives a clearer illustration of the inner wall 12, and how the heat exchange chamber 6 is defined by the shell 5, the upper plate 19, the lower plate 10 and the inner wall 12.

LIST OF FEATURES LABELLED IN THE FIGS

1 Hair strainer
2 Drainpipe inlet

3 liquid outlet
4 Quick connector
5 Shell
6 heat exchange chamber
7 liquid inlet
8 Quick connector
9 Bottom plate
10 Lower plate
11 lower trap conduit
12 Inner wall
13 Plurality of drainpipes
14 Rise wall
15 trap conduit
16 O-ring
17 heat exchanger baffles
18 groove
19 upper plate
20 Longitudinal direction Z
21 opening in/above rise wall
22, 23 openings in drainpipe fitting
100 heat exchanger water trap
101 drainpipe fitting

The invention claimed is:

1. A heat exchanger water trap for transferring heat from drainpipe discharge, said heat exchanger water trap comprising:

a shell being substantially cylindrical and having a longitudinal direction Z, said shell comprising a liquid inlet for receiving a liquid to be heated and a liquid outlet for said liquid to exit once heated, a heat exchange chamber, a plurality of drainpipes for receiving a discharge liquid, selected from the group consisting of wastewater and hot bathing water, said drainpipes having an inner surface and an outside surface, wherein said plurality of drainpipes passing through the heat exchange chamber, whereby the liquid to be heated is in contact with at least part of the outside surface of said plurality of drainpipes, characterized in that the heat exchange chamber is defined by the shell, an upper plate, a lower plate at least partially covering the interior of the shell and an inner wall and that the plurality of drainpipes and the inner wall are extending in the longitudinal direction Z, wherein the inner wall is positioned inside the substantially cylindrical shell.

2. A heat exchanger water trap according to claim 1 which further comprises a discharge system, said discharge system comprising a rising chamber and a trap conduit wherein said discharge system is positioned inside the substantially cylindrical shell.

3. A heat exchanger water trap according to claim 2, wherein the discharge system is defined by the shell, the lower plate, the inner wall extending in the longitudinal direction, the upper plate and a bottom plate, the discharge system further comprising a rise wall extending in the longitudinal direction.

4. A heat exchanger water trap according to claim 1, where the liquid outlet is mounted gravitationally higher than said liquid inlet.

5. A heat exchanger water trap according to claim 1, where the liquid inlet and the liquid outlet comprise mounting means in the form of quick connectors.

6. A heat exchanger water trap according to claim 1, comprising a releasably attached hair strainer.

7. A heat exchanger water trap according to claim 1, which further comprises a plurality of heat exchanger baffles.

8. A heat exchanger water trap according to claim 7, where the plurality of heat exchanger baffles are aligned in a parallel configuration.

9. A heat exchanger system comprising a heat exchanger water trap according to claim 1, and a drainpipe fitting, the drainpipe fitting having openings for connecting with existing piping circulating the fluid to be heated, said openings further being adapted to connect with the liquid inlet and the liquid outlet of the heat exchanger water trap, respectively.

10. A heat exchanger water trap according to claim 3, where the liquid outlet is mounted gravitationally higher than said liquid inlet.

11. A heat exchanger water trap according to claim 10, comprising a releasably attached hair strainer.

12. A heat exchanger water trap according to claim 1, comprising a releasably attached hair strainer.

13. A heat exchanger water trap according to claim 11, further comprising a plurality of heat exchanger baffles wherein the plurality of heat exchanger baffles are aligned in a parallel configuration.

14. A heat exchanger system comprising a heat exchanger water trap according to claim 13 and a drainpipe fitting, the drainpipe fitting having openings for connecting with existing piping circulating the fluid to be heated, said openings further being adapted to connect with the liquid inlet and the liquid outlet of the heat exchanger water trap, respectively.

15. A heat exchanger water trap according to claim 1, further comprising a plurality of heat exchanger baffles wherein the plurality of heat exchanger baffles are aligned in a parallel configuration.

16. A method of transferring heat between a discard liquid, selected from the group consisting of wastewater and heated bathing water, and a liquid to be heated without mixing the discard liquid and the liquid to be heated comprising the steps of:

splitting the discard liquid into a plurality of discard streams, introducing a liquid to be heated into a heat exchanger chamber surrounding a plurality of drainpipes being substantially vertically arranged through which the plurality of discard streams passes, forcing the liquid to be heated to pass the plurality of drainpipes multiple times, releasing the liquid to be heated in a heated state at a gravitationally higher point than when it was introduced, collecting and combining the discard streams into a cooled discard liquid, and discarding the cooled discard liquid via a weir, wherein the heat exchanger chamber comprises a substantially cylindrical shell surrounding the plurality of drainpipes and an inner wall having a longitudinal Z direction positioned within the substantially cylindrical shell.

17. A method of using a heat exchanger water trap for heating water, comprising the steps of, introducing the water to be heated into a heat exchanger chamber surrounding a plurality of drainpipes that are substantially vertically arranged and pass through the heat exchanger chamber, whereby the liquid to be heated is in contact with at least part of the outside surface of said plurality of drainpipes and the heat exchange chamber is defined by a shell, an upper plate, a lower plate at least partially covering an interior of the shell and an inner wall, and wherein the plurality of drainpipes and the inner wall extend in the longitudinal direction Z, and the inner wall is positioned inside the substantially cylindrical shell, forcing the water to be heated to pass the plurality of drainpipes multiple times, releasing the water to be heated in a heated state at a gravitationally higher point than when it was introduced, collecting and combining the discard streams into a cooled discard liquid, and discarding the cooled discard liquid via a weir.

* * * * *